United States Patent [19]

Dunn

[11] Patent Number: 4,602,533

[45] Date of Patent: Jul. 29, 1986

[54] ADJUSTABLE WRENCH

[75] Inventor: Joe L. Dunn, Bowie, Tex.

[73] Assignees: Donnie W. Dunn; Lisa A. Dunn, both of Aspermont; James H. Catlow, Houston; Lyndon R. Dunn, Aspermont; Willie M. Dunn, Aspermont; Donna S. Dunn, Aspermont; Rodger B. Wilkins, Aspermont; Lee A. Wilkins, Aspermont, all of Tex.

[21] Appl. No.: 696,637

[22] Filed: Jan. 30, 1985

[51] Int. Cl.[4] ..... B25B 13/14

[52] U.S. Cl. ..... 81/134; 81/129.5; 81/139; 81/142

[58] Field of Search ..... 81/134, 139, 142, 129.5, 81/98, 111, 90.1, 90.9

[56] References Cited

U.S. PATENT DOCUMENTS

| | | | |
|---|---|---|---|
| 109,913 | 12/1870 | Knisely . | |
| 327,559 | 10/1885 | Langstrom | 81/98 |
| 341,503 | 5/1886 | Quigley . | |
| 389,549 | 9/1888 | Crosby | 81/134 |
| 648,769 | 5/1900 | Meyer . | |
| 670,890 | 3/1901 | Burgess . | |
| 962,738 | 6/1910 | Bledsoe | 81/139 |
| 1,027,830 | 5/1912 | Foster | 81/134 |
| 1,131,567 | 3/1915 | Skalicky | 81/134 |
| 1,147,782 | 7/1915 | Carlson | 81/111 |
| 1,185,911 | 6/1916 | Johnston et al. . | |
| 1,436,049 | 11/1922 | Oliver | 81/129.5 |
| 1,468,913 | 9/1923 | Miller . | |
| 1,539,987 | 6/1925 | Bell | 81/142 |
| 2,774,271 | 12/1956 | Mano . | |
| 3,563,118 | 2/1971 | Rydell | 81/129 |

FOREIGN PATENT DOCUMENTS

| | | | |
|---|---|---|---|
| 18942 | of 1896 | United Kingdom | 81/134 |

*Primary Examiner*—Frederick R. Schmidt
*Assistant Examiner*—J. T. Zatarga
*Attorney, Agent, or Firm*—Murray Robinson; Anastassios Triantaphyllis; David A. Rose

[57] ABSTRACT

A wrench having a stationary jaw mounted on a handle, a rigid member releasably attached to the handle and an adjustable jaw disposed on the rigid member, the rigid member retaining the adjustable jaw in an interengageable position with the handle when the rigid member is locked with the handle by a latch.

18 Claims, 4 Drawing Figures

ADJUSTABLE WRENCH

BACKGROUND OF THE INVENTION

The present invention relates generally to the field of tools and, more particularly, to wrenches. Still more particularly, the present invention includes an adjustable wrench for grasping a nut, a bolt head, or the like, and for applying a turning force thereto.

Throughout the years, the widespread use of nuts, bolts or the like has resulted in the development of a great number of wrenches varying in size, shape or operating mechanism. One type of wrench has grasping mouths of fixed size, whereby a particular wrench can be used for performing an operation on a particular size object only. An advantage of such wrenches is that both jaws are integrally connected to the body of the wrench and therefore, they are not subject to play or movement caused by the pressure exerted on them during operation. However, the same wrenches have the disadvantage that one wrench may be used for a particular size object only and therefore, one must have many different wrenches for the different size objects. In order to overcome this difficulty, adjustable wrenches have been developed so that by adjusting the opening of the grasping mouth of the wrench, one may use the same tool to apply a turning force on objects of various sizes. Such adjustable wrenches are disclosed in U.S. Pat. Nos. 109,913, 341,503, 648,769, 670,890, 1,185,911, 1,468,913, 2,774,271 and 3,563,118.

In general, adjustable wrenches include a fixed jaw and a movable jaw that may be adjusted to different positions to form a mouth opening therebetween suitable for a particular operation on a particular size nut, bolt head or the like. During the turning operation, the force exerted by the jaws on the nut and consequently, the reaction force therefrom is of great magnitude biasing the movable jaw away from the fixed jaw. Therefore, unless provisions are made to prevent it, the movable jaw tends to move in a direction away from the fixed jaw, thereby causing the disengagement of the object being turned.

In the prior art, attempts were made to develop a mechanism for preventing the movement of the movable jaw away from the fixed jaw during turning. U.S. Pat. No. 109,913 discloses a wrench which includes a fixed jaw, a guide member, a movable jaw sliding on the guide member and a lever pivotally attached to the movable jaw having a pin extending therefrom. The movable jaw is kept in a desired position by pressing the lever towards the guiding member to engage the pin with the guiding member and to prevent sliding of the movable jaw on the guide member. One difficulty with this wrench is that this sliding prevention mechanism cannot withstand the biasing forces exerted on the movable jaw during operation resulting in the displacement of the movable jaw and the disengagement of the object. Furthermore, this wrench requires a continuous usage of the operator's hand pressing the lever against the guide member to hold the movable jaw in a fixed position.

U.S. Pat. No. 341,503 discloses an adjustable wrench including a fixed jaw, a guide member, a movable jaw, a binding sleeve and a spring. The binding sleeve is biased towards the guide member by the spring and the frictional force therebetween is used to prevent the binding sleeve from sliding along the guide member. The binding sleeve provides a stop surface for the movable jaw to prevent it from moving away from the fixed jaw. One difficulty of this wrench is that this sliding prevention mechanism is not effective when a force of high magnitude is exerted on the movable jaws because it relies solely on the frictional force created by the spring force. Another difficulty is that the wrench has to be adjusted on the object to set the required opening.

Some wrenches utilize not only a spring providing a biasing force against the movement of the movable jaw, but also, teeth on various parts of the wrench providing a better engagement between the movable jaw and the fixed portions of such wrench. U.S. Pat. No. 648,719 discloses an adjustable wrench having a fixed jaw, a guide piece with teeth, and a movable jaw with an arm sliding over the guide piece. The arm includes a triangular catch piece that is biased by a spring to engage the teeth of the guide piece to retain the movable jaw in a fixed position. U.S. Pat. No. 670,890 discloses a fixed jaw, a guide piece, a movable jaw slidable on the guide piece, a lever pivotally attached to the movable jaw having teeth and a spring biasing the lever against the guide piece so that the teeth may engage the guide piece to prevent the movable jaw from sliding on the guide piece when it is set in a fixed position. U.S. Pat. No. 1,185,911 discloses a fixed jaw, a guiding piece having teeth, a movable jaw having teeth adapted to engage the teeth of the guiding piece and the spring biasing movable jaw against the guide piece causing the teeth of the movable jaw to engage the teeth of the guide piece in order to retain the movable jaw in a fixed position. U.S. Pat. No. 1,468,913 discloses a wrench having a fixed jaw, a guide piece having a recess, a movable jaw having an arm adapted to slide in the recess of the guide piece and a spring having a spring finger with teeth adapted to engage corresponding teeth on the arm to keep the arm and the movable jaw in a fixed position. The spring biases the spring finger against the arm of the movable jaw thereby retaining the teeth engagement thereof. The arm of the movable jaw includes also an opening adapted to slide over a crossbar in the recess of the guide piece. The crossbar is shaped accordingly to prevent the pivotal movement of the arm and the movable jaw with respect to the fixed jaw. Furthermore, the surface of the arm opening includes teeth engaging the crossbar when the movable jaw is biased by the spring to the fixed position thereby providing an additional mechanism preventing the movable jaw and its arm from sliding in the recess away from the fixed jaw.

One disadvantage of the aforementioned wrenches that utilize teeth and a spring to provide the biasing force preventing the movement of the movable jaw is that resetting of the movable jaw requires the use of manual force equal to the restoring force of the spring. Therefore, the restoring force of the spring should be limited to one that can be overcome by manual force. Such force is not adequate for the prevention of the displacement of the movable jaw when a very high force is exerted on the nut during a turning operation. However, if such spring were used, it would be extremely difficult to manually adjust the movable jaw.

U.S. Pat. No. 2,774,271 discloses an adjustable wrench having a fixed jaw, a slide piece, a movable jaw sliding along the slide piece and an operating arm pivotally connected to the fixed jaw. In order to maintain the movable jaw in a fixed position, the operating arm is manually biased toward the slide member until its pointed back edge engages teeth present on the movable jaw. Therefore, the movable jaw, due to the engagement of the pointed edge and the teeth, is prevented from sliding along the guide piece. One disadvantage of this wrench is that the biasing force is provided manually and therefore, it may be easily overcome when the turning force reaches a high magnitude resulting in the movement of the movable jaw away from the fixed jaw.

U.S. Pat. No. 3,563,118 includes a fixed jaw, a guide piece, an opening or slide away extending therethrough in a direction perpendicular to the jaw face, a movable jaw having a mounting section adapted to fit in the above mentioned opening and a lever member being operated by hand to regulate the opening formed between the fixed jaw and the movable jaw. Once in a fixed position, the movable jaw is prevented from moving away from the fixed jaw because of the mating engagement between a dovetail portion of its mounting member and a similarly shaped inner portion of the opening of the guide piece. One disadvantage of this wrench is that it lacks stability when a high turning force is experienced because the mating engagement may collapse when such high force is exerted on the movable jaw.

The present invention eliminates the difficulties and drawbacks of the prior art by providing an adjustable wrench with a movable jaw that, during the turning operation, may not be displaced from its designated position when the magnitude of the turning force applied by the wrench on a nut, a bolt head or the like becomes very large. Therefore, this wrench eliminates the troublesome play between the various parts of an adjustable wrench and the accompanying disengagement of the object being turned so that its operation may be performed effectively and efficiently. Furthermore, the present invention provides an adjustable wrench that may be adjusted in precise increments with speed, ease and accuracy without placing the wrench on the object that needs to be turned.

Other objects and advantages of the invention will appear from the following description.

SUMMARY OF THE INVENTION

Accordingly, the present invention provides an adjustable wrench designed to perform turning operations without encountering operating problems caused by play between the various parts. The adjustable wrench includes a handle, a stationary jaw pivotally attached to the handle, a rigid member extending from the stationary jaw, an adjustable jaw adapted to slide along the rigid member and a latch for locking the rigid member to the handle.

In operation, the adjustable jaw is moved reciprocally along the rigid member until it forms the desired mouth opening with the stationary jaw, whereupon the rigid member carrying the adjustable jaw is pivotally rotated to lock it to the handle by the latch. In that position, teeth present on one end of the adjustable jaw engage teeth present on one end of the handle to prevent the adjustable jaw from moving away from the stationary jaw and the rigid member abuts the adjustable jaw and holds it against the handle to prevent the disengagement of the aforementioned toothed connection, whereby the adjustable jaw remains stationary during the turning operation free of troublesome play and slippage regardless of the magnitude of the turning force encountered during the operation.

Hence, the present invention is an adjustable wrench. The prior art shows adjustable wrenches; however, such wrenches are not free of play because the locking-down devices used, such as springs, are not rigid and therefore they cannot provide the required stability when high turning forces are encountered.

These and various other characteristics and advantages of the present invention will become readily apparent to those skilled in the art upon reading the following detailed description.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENTS

Figure 1:
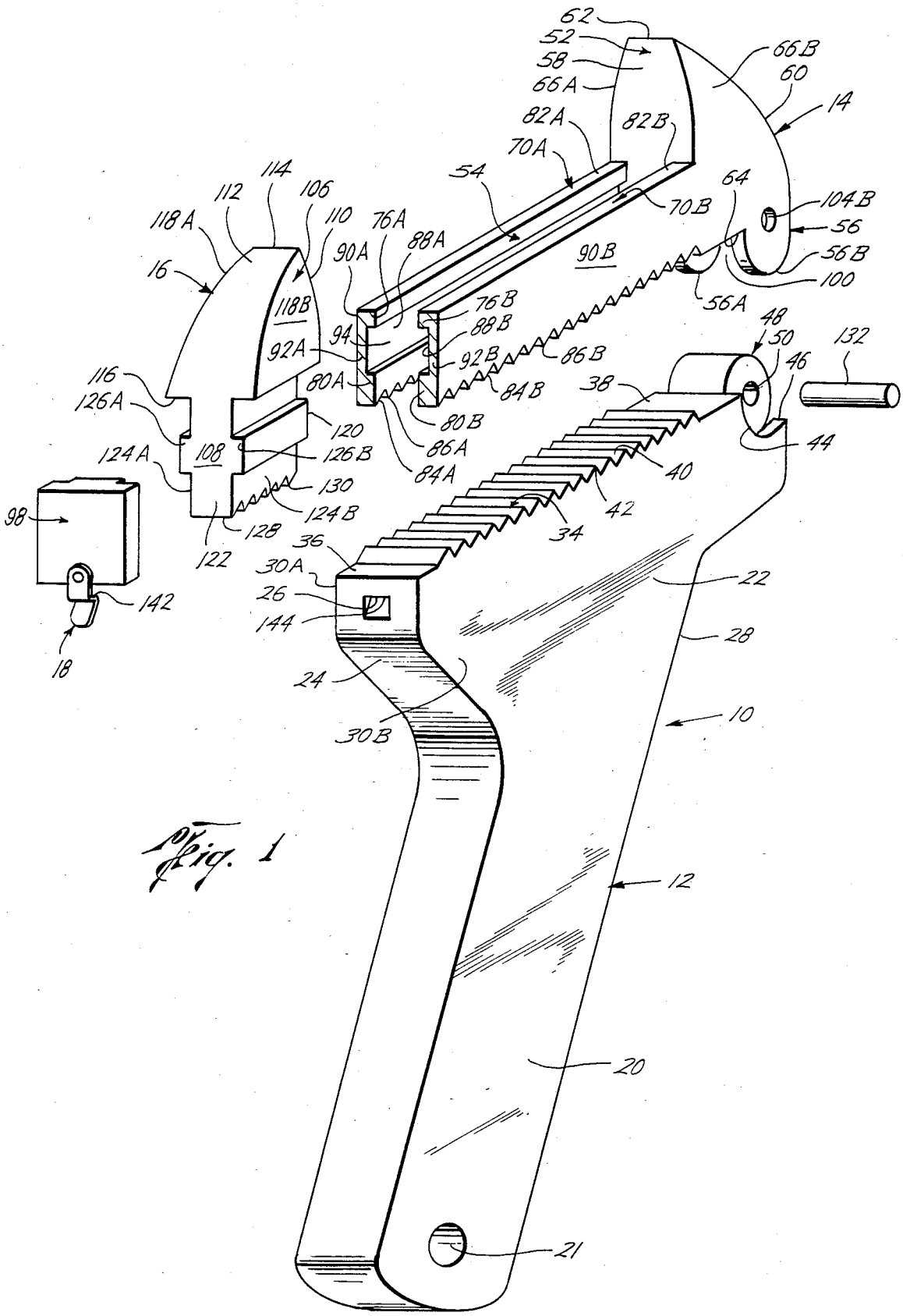
FIG. 1 is an exploded perspective view of the apparatus made in accordance with the present invention.

Referring now to the preferred embodiment shown in FIG. 1, there is shown an unassembled adjustable wrench 10, according to the present invention comprising a solid wrench body 12, a wrench head 14, an adjustable jaw 16 and locking means thereof, here a latch 18. Wrench body has an elongated handle 20 that includes a suspension hole 21 for suspending wrench 10 from a nail or the like when not in use, and an enlarged transition section 22 depending therefrom for connecting wrench head 14 and adjustable jaw 16 to wrench body 12, as hereinafter described. Transition section 22 includes a front edge 24 having a groove 26 for receiving latch 18, a back edge 28, symmetrical flat sides 30A, B and a connecting end 34 having flat portions 36, 38, toothed portion 40 therebetween having teeth 42, and a cut-away portion 44 between end 34 and back edge 28 forming housing 46. Housing 46 partially houses a circular pivot plate 48 being integrally connected thereto and having a pinhole 50.

Head 14 includes a stationary jaw 52, a rigid member or adjustable jaw guide 54 and a double clevis 56. Stationary jaw 52 has a flat gripping face 58, a curved back 60 forming a ridge 62 with face 58, a bottom end 64 and two identical, mostly flat, sides 66A, B. Adjustable jaw guide 54 is formed by two spaced apart, identical, elongated flat plates 70A, B that are perpendicular to gripping face 58. Plate 70A includes first elongated edge 82A towards ridge 62, second elongated edge 84A being in tandem with end 64 of jaw 52 and having teeth 86A adapted to engage teeth 42, interior wall 88A, exterior plate side 90A and narrow end 92A. Similarly, plate 70B includes identical first elongated edge 82B, second elongated edge 84B having teeth 86B, interior wall 88B, exterior plate side 90B and narrow end 92B. The elongated opening formed between plates 70A, B is partially closed adjacent edges 82A, B by elongated flanges 76A, B being integrally attached to and extending from plates 70A, B, respectively. Similarly, the elongated opening formed between plates 70A, B is partially closed adjacent edges 84A, B by elongated flanges 80A, B that are integrally attached to and extend from plates 70A, B, thereby forming housing 94 suitable for receiving, guiding and locking adjustable jaw 16, hereinafter described. The narrow end of the elongated opening formed between plates 70A, B that is adjacent narrow ends 92A, B remains open while the tool is unassembled to allow the insertion of adjustable jaw 16 in housing 94. A closure wall 98 is utilized to close it following such insertion. Double clevis 56 includes two identical parallel portions 56A, B being integrally attached to bottom end 64 and in tandem with flat sides 66A, B of stationary jaw 52, respectively, and forming a housing 100 therebetween. Portions 56A, B have pinholes 104A, B (only pinhole 104B is shown) for connecting double clevis 56 to pivot plate 48, as hereinafter described.

Adjustable jaw 16 includes a gripping portion 106 and a mounting tongue 108. Gripping portion 106 has a flat gripping face 110, a curved back 112 forming a ridge 114 with face 110, a bottom end 116 and two identical flat sides 118A, B. Mounting tongue 108, integrally attached to end 116 of gripping portion 106, includes two identical parallel, narrow sides 120, 122 in tandem with face 110 and curved back 112, respectively, two identical parallel wide sides 124A, B, two identical elongated flanges 126A, B extending from the middle portions of sides 124A, B, respectively, and a bottom end 128 having teeth 130 adapted to engage teeth 42 of body 12.

Figure 2:
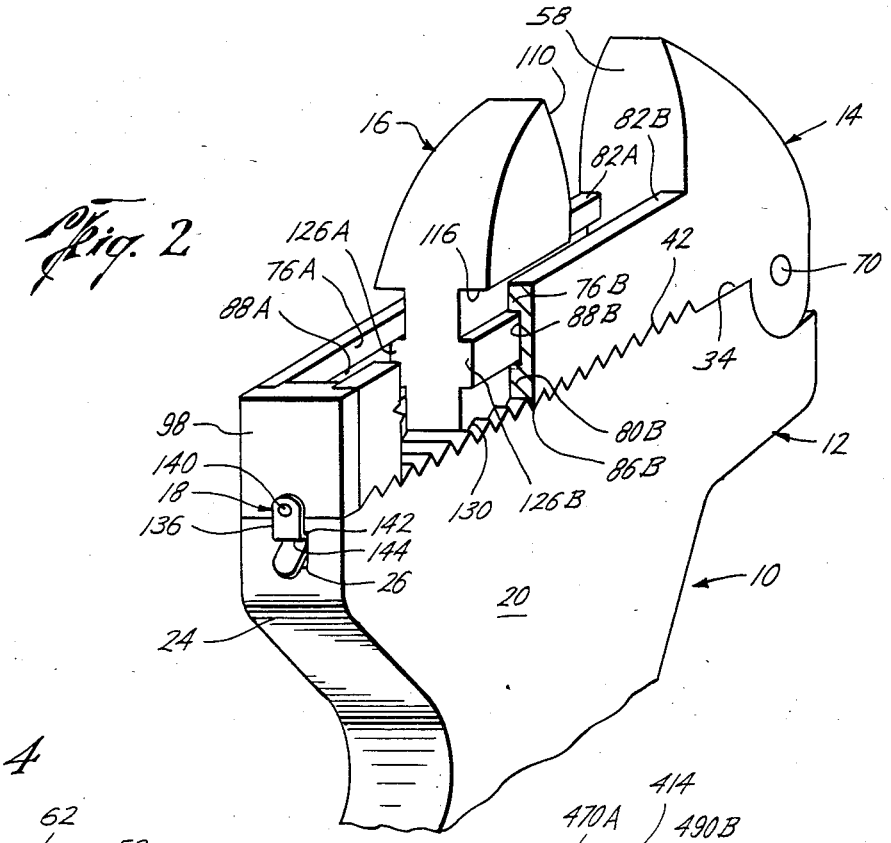
FIG. 2 is a fragmentary, part cross sectional perspective view of the apparatus of FIG. 1 in the locked position.

In the assembled position, adjustable jaw 16 is received by adjustable jaw guide 54 of head 14 by slidingly inserting mounting tongue 108 in housing 94 through the open end. The open end is closed by permanently or removably attaching closure wall 98 to ends 92A, B. A permanent attachment wherein closure wall 98 is welded on plates 70A, B is shown in FIG. 2. A removable attachment, not shown, may be facilitated, for example, by inserting a suitably dimensioned closure wall 98 in the narrow end of the elongated opening formed between plates 70A,B and retaining it therein with a pin inserted in aligned pinholes in plates 70A,B and closure wall 94. Jaw 16 may slide freely between closure wall 98 and gripping face 58 in housing 94. Wrench head 14 is pivotally attached to wrench body 12 by placing double clevis 56 over pivot plate 48 in housing 46, aligning pinhole 50 with pinholes 104A, B and inserting a pin 132 securely therethrough.

Referring now to FIG. 2, there is shown adjustable wrench 10 in a locked position ready to perform an operation. Wrench head 14 is pivotally rotated to rest on wrench body 12 and adjustable jaw 16 is slidingly moved to a position forming the necessary opening between gripping faces 58, 110 for gripping a workpiece such as a nut or the like. Adjustable jaw 16 is locked in that position by matingly engaging teeth 130 of jaw 16 and teeth 86A, B of plates 70A, B with teeth 42 of wrench body 12 and by matingly attaching head 14 to body 12 with latch 18. Latch 18 has a flat member 136 being connected to the exterior surface of closure wall 98 via screw 140 and being biased against front edge 24 and into groove 26 by internal spring loading. Flat member 136 includes a shoulder 142 abutting stop shoulder 144 of groove 26 whereby head 14 may not pivotally rotate away from body 12 unless latch 18 is manually disengaged from groove 26. In the locked position, jaw 16 is biased against connecting end 34 by flanges 76A, B, abutting flanges 126A, B, respectively, whereby jaw 16 is prevented from sliding in a direction perpendicular to gripping face 58 or in a direction perpendicular to connecting end 34. Furthermore, jaw 16 is prevented from sliding in a direction perpendicular to parallel plates 70A, B because flanges 126A, B are in intimate contact with interior walls 88A, B, respectively. Therefore, in the locked position, jaw 16 remains stationary to perform its operation without any play between the various parts and without any change in the opening between gripping faces 58, 110. In the locked position, elongated edges 82A, B of plates 70A, B are spaced apart from bottom end 116, and flanges 80A, B (80A is not shown in FIG. 2) are spaced apart from 126A, B to minimize the contact between the interfacing surfaces. Therefore, the probability of "freezing" between head 14 and jaw 16 due to rusting in the event adjustable wrench 10 remains locked for a considerable period of time is reduced. It must be noted that due to the unique and novel configuration of wrench 10, the aforementioned spacing does not affect the stability of the locked engagement between body 12, head 14 and jaw 16. Following the performance of the operation, latch 18 may be pulled away from groove 26 to unlock wrench 10 so that wrench 10 may be reset, cleaned, stored or the like.

It should be noted that teeth 42, teeth 130 and teeth 86A, B may be sized accordingly to use them as means for determining the size of the opening of the mouth formed between stationary jaw 52 and adjustable jaw 16 by counting, for example, the number of teeth present in the mouth between jaws 52 and 16, or for determining the incremental movement of the adjustable jaw 16 from one position to another by counting, for example, the number of teeth between the two positions. Therefore, one would be able to adjust the wrench to the desired size without placing it on the work piece when the size of such work piece is known. Furthermore, it should be understood that one may size the teeth accordingly to set the number and the size of mouth opening increments desired for a particular wrench and that one may show the size of each increment and the size of the entire mouth opening by appropriate markings on the side of jaw guide 54 or on the upper portion of flat sides 30A or B.

Figure 3:
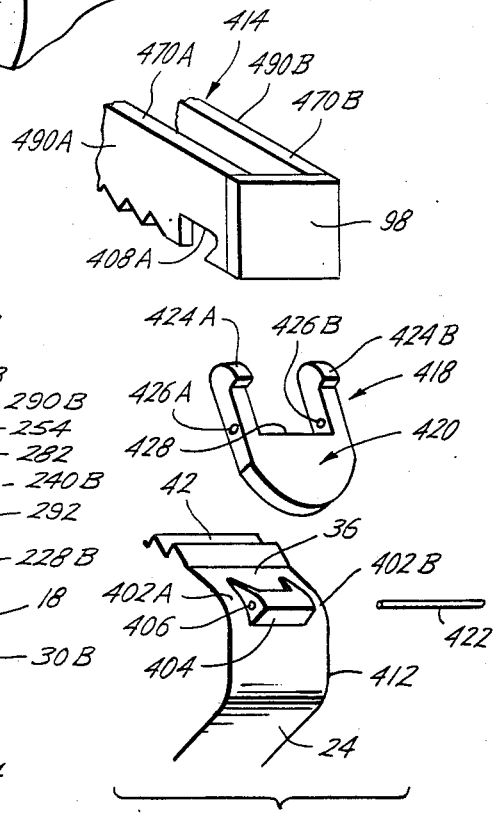
FIG. 3 is a fragmentary, exploded perspective view of the apparatus depicted in FIGS. 1 and 2 showing an alternative latching mechanism thereof.

Referring now to FIG. 3 there is shown a latch 418 that can be used as an alternative to latch 18 for the embodiment shown in FIG. 1. In order to accommodate such mechanism a wrench body 412 is utilized that is similar with previously described wrench body 12 shown in FIG. 1 except that wrench body 412 has symmetrical recesses 402A,B on flat sides 30A, B, respectively, connecting flat portion 36 and front edge 24, a heel 404 on front edge 24 extending from recess 402A to recess 406B, and a pinhole 406 connecting recesses 402A, B. Furthermore, a wrench head 414 is utilized that is similar to wrench head 14 shown in FIG. 4 except that plates 470A,B of wrench head 412 have notches 408A, B (notch 408B is not shown) on exterior plate sides 490A, B, respectively, adjacent closure wall 98 for hooking latch 418.

Latch 418 includes a clevis 420 and a pin 422. Clevis 420 has on both ends hooks 424A, B that are perpendicular thereto, aligned pinholes 426A, B, and an interior surface 428 that is geometrically compatible with heel 404. In the assembled position, clevis 420 is received in recesses 402A, B and is attached to body 412 via pin 422 that is inserted in aligned pinholes 426A, B and 406. In that position, clevis 420 may pivot with respect to pin 422 to hook hooks 429A,B in nothces 408A, B, respectively, and to lock latch 418.

It should be understood that the geometrical configuration of hooks 424A, B and notches 408A, B, as it is clearly shown in FIG. 3 is such that, in the locked position, any movement of wrench head 414 away from its intimate engagement with wrench body 412 should be accompanied by a similar movement of clevis 420. However, it should be understood that, as it is also clearly shown in FIG. 3, clevis 420 could not be displaced in that direction because heel 404 abutting interior 428 of clevis 420 provides a stop thereto, whereby in the locked position wrench head 414 would not move unless hooks 424A, B or clevis 420 brake. Therefore, by constructing the aforementioned pieces with well known strong steel material the wrench can remain locked when high turning forces are encountered.

It should also be understood that due to the geometric configuration of the wrench of the present invention other mechanisms may be used to keep the wrench shown in FIGS. 1 and 2, as well as the wrench shown in FIG. 4 and described hereinafter, in a locked position so long as the materials used in constructing such mechanisms are strong enough to withstand the pulling forces that may be exerted thereon by the turning forces encountered during the turning operation.

Figure 4:
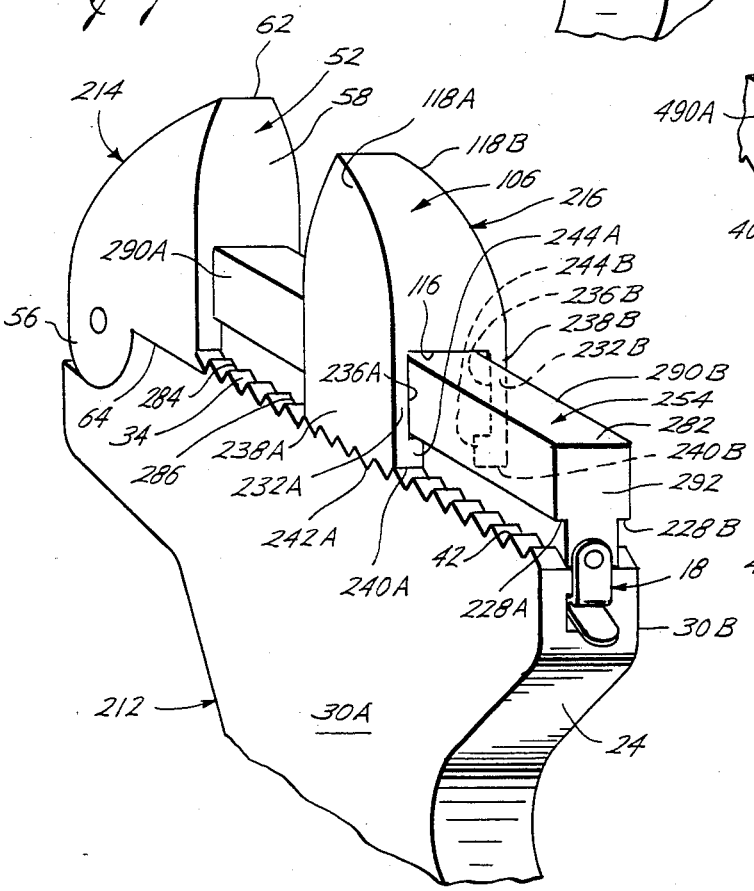
FIG. 4 is a fragmentary, perspective view of another embodiment of the apparatus shown in FIGS. 1 and 2.

Referring now to FIG. 4, there is shown another embodiment of the present invention in the locked position having a wrench body 212 similar to wrench body 12 shown in FIG. 1, a wrench head 214, an adjustable jaw 216 and a latch 218 similar to latch 18 shown in FIG. 1. Head 214 includes a stationary jaw 52 and a double clevis 56 similar to those of previously described head 14. Furthermore, head 214 includes a rigid member or adjustable jaw guide 254 in the shape of an elongated bar being perpendicular to gripping face 58. Jaw guide 254 has a first elongated edge 282 towards ridge 62, a second elongated edge 284 being in tandem with end 64 of jaw 52 and having teeth 286 engaging teeth 42, a narrow end 292, side surfaces 290A, B, and flanges 228A, B extending perpendicularly from side surfaces 290A, B, respectively.

Adjustable jaw 216 includes a gripping portion 106, similar to that of the previously described embodiment, and two identical parallel plates 232A, B, integrally attached to and extending from bottom end 116 of gripping portion 106 in tandem with flat sides 118A, B, and forming an elongated opening or channel therebetween. Parallel plates 232A, B include interior surfaces 236A, B, exterior surfaces 238A, B, bottom ends 240A, B, having teeth 242A, B, (teeth 242B are not shown) engaging teeth 42, and inwardly projecting flanges 244A, B, adjacent ends 240A, B forming inwardly projecting extensions of bottom ends 240A, B and teeth 242A, B.

Still referring to FIG. 4, adjustable jaw 216 received over jaw guide 254 is slidingly moved thereon to a position forming the necessary opening between gripping faces 58, 110 for gripping a work piece such as a nut or the like and wrench head 214 is pivotally rotated to rest on wrench body 212. In that position, teeth 286 and teeth 242A, B matingly engage teeth 42 whereby head 214 matingly attaches to body 212. Wrench body 212, wrench head 214 and adjustable jaw 216 are locked in that position with latch 18. In the locked position, flanges 228A, B abut flanges 244A, B, respectively, whereby jaw 216 is prevented from sliding in a direction perpendicular to gripping face 58 or in a direction perpendicular to connecting end 34. Furthermore, jaw 216 is prevented from sliding in a direction perpendicular to side surfaces because interior surfaces 236A, B of plates 232A, B are in intimate contact with side surfaces 290A, B, respectively. Therefore, in the locked position, jaw 216 remains stationary to perform its operation without any play between the various parts and without variations in the opening between gripping faces 58, 110 until the operation is completed. In the locked position, bottom end 116 of gripping portion 106 is spaced apart from first elongated edge 282 of jaw guide 254 to minimize the contact between the interfacing surfaces, thereby reducing the probability of "freezing" between jaw guide 254 and jaw 216 without affecting the stability of the locked engagement of the wrench during operation.

While preferred embodiment of the present invention have been shown and described, modifications thereof can be made by one skilled in the art without departing from the spirit of the invention.

What is claimed is:

1. A wrench, comprising:
a body having a first jaw disposed thereon;
a releasable member releasably attached to said body and having first teeth thereon;
a second jaw being reciprocally disposed on said releasable member and having second teeth thereon, said second jaw having a portion thereof disposed between said body and a portion of said releasable member;
said body having third teeth engageable with said first and second teeth for disposing said second jaw on said body upon the attachment of said releasable member to said body.

2. The wrench according to claim 1 wherein said releasable member is securely affixed to said first jaw.

3. The wrench according to claim 1 further including latch means for releasably attaching said releasable member to said body.

4. The wrench according to claim 1 wherein said second jaw is movably mounted on said releasable member.

5. A wrench for gripping a work piece, comprising:
a handle having a stationary jaw disposed thereon;
a rigid member releasably mounted on said handle;
an adjustable jaw being reciprocally disposed on said rigid member, said adjustable jaw having a portion thereof disposed between said handle and a portion of said rigid member; and
said rigid member clamping said adjustable jaw in a predetermined position on said handle when said rigid member is mounted on said handle said adjustable jaw and said stationary jaw being on the same side of the rigid member so as to cooperate to perform the wrench function of gripping therebetween.

6. The wrench according to claim 5 wherein said adjustable jaw is movably mounted on said rigid member to move to said predetermined position.

7. The wrench according to claim 6 wherein said rigid member has channel means for receiving a projection from said adjustable jaw.

8. The wrench according to claim 6 wherein said adjustable jaw includes an aperture receiving said rigid member.

9. The wrench according to claim 6 further including means for positioning said adjustable jaw with respect to said handle.

10. The wrench according to claim 9 wherein said positioning means includes first interengageable means on said handle for engaging second interengageable means on said adjustable jaw.

11. The wrench according to claim 10 wherein said rigid member includes third interengageable means for engaging said first interengageable means.

12. The wrench according to claim 11 wherein said first, second, and third interengageable means are teeth adapted for locking engagement therebetween.

13. The wrench according to claim 5 wherein the end portions of said rigid member are connected to said handle.

14. The wrench according to claim 5 wherein one end of said rigid member is pivotally disposed on said handle.

15. The wrench according to claim 5 further including latch means for connecting one end of said rigid member to said handle.

16. The wrench according to claim 5 wherein said rigid member is mounted on said stationary jaw.

17. The wrench according to claim 5 further including spacing teeth for determining the distance between said stationary jaw and said adjustable jaw.

18. A wrench for gripping a work piece, comprising:

a handle having a stationary jaw disposed thereon;

a rigid member having one end pivotally disposed on said handle, said rigid member having first teeth thereon;

latch means for connecting another end of said rigid member to said handle;

an adjustable jaw being reciprocally mounted on said rigid member, said adjustable jaw having a portion thereof disposed between said handle and a portion of said rigid member, said adjustable jaw having second teeth thereon;

said rigid member having channel means for receiving a projection from said adjustable jaw;

said rigid member clamping said adjustable jaw in a predetermined position on said handle when said rigid member is mounted on said handle; and said handle having third teeth engageable with said first and second teeth for disposing said adjustable jaw on said handle upon the clamping of said rigid member to said handle.

* * * * *

UNITED STATES PATENT AND TRADEMARK OFFICE

CERTIFICATE OF CORRECTION

PATENT NO. : 4,602,533

DATED : July 29, 1986

INVENTOR(S) : Joe Lynn Dunn

It is certified that error appears in the above—identified patent and that said Letters Patent is hereby corrected as shown below:

On Column 4, line 34, after "body", insert ---12---.

On Column 7, line 1, change "nothces" to ---notches---.

On Column 7, line 14, change "brake" to ---break---.

On Column 8, line 16, change "embodiment" to ---embodiments---.

Signed and Sealed this

Seventh Day of October, 1986

[SEAL]

*Attest:*

DONALD J. QUIGG

*Attesting Officer*

*Commissioner of Patents and Trademarks*